US005725213A

United States Patent [19]

Kuczynski

[11] Patent Number: 5,725,213

[45] Date of Patent: Mar. 10, 1998

[54] PUZZLE CONSTRUCTION

[76] Inventor: Otto Kuczynski, 715 Terrace Heights, Wyckoff, N.J. 07481

[21] Appl. No.: 787,306

[22] Filed: Jan. 24, 1997

[51] Int. Cl.[6] ..... A63F 9/08

[52] U.S. Cl. ..... 273/153 S; 273/157 R

[58] Field of Search ..... 273/153 R, 157 R, 273/153 S, 157 A

[56] References Cited

U.S. PATENT DOCUMENTS

| | | | |
|---|---|---|---|
| 207,124 | 8/1878 | Kinsey | 273/153 S |
| 278,571 | 5/1883 | MacKenzie | 273/153 S |
| 743,469 | 11/1903 | Denison . | |
| 1,017,752 | 2/1912 | Hardy . | |
| 1,082,460 | 12/1913 | Bushfield | 273/153 S |
| 1,085,994 | 2/1914 | Patterson | 273/153 S |
| 1,633,397 | 6/1927 | Diamond . | |
| 1,683,014 | 9/1928 | Babcock . | |
| 2,779,598 | 1/1957 | Steinhardt | 273/157 R |
| 4,269,414 | 5/1981 | DeVos et al. . | |
| 4,283,052 | 8/1981 | Windisch . | |
| 4,838,551 | 6/1989 | Volpert | 273/157 R |
| 4,863,172 | 9/1989 | Rosenwinkel et al. . | |
| 5,060,948 | 10/1991 | Hausner . | |
| 5,209,480 | 5/1993 | Katz . | |
| 5,267,732 | 12/1993 | Bowen et al. | 273/157 R |
| 5,497,171 | 3/1996 | Teres et al. . | |
| 5,529,301 | 6/1996 | Feller | 273/153 S |

FOREIGN PATENT DOCUMENTS

| | | | |
|---|---|---|---|
| 381813 | 10/1932 | United Kingdom | 273/153 S |

*Primary Examiner*—Steven B. Wong
*Attorney, Agent, or Firm*—Klauber & Jackson

[57] ABSTRACT

An improvement is disclosed in a puzzle of the type including a rectangular base piece, a raised rectangular frame surrounding the sides of the base piece and defining therewith a recessed platform; and a plurality of rectangular flattened pieces which are positionable on said platform within said frame, and of dimensions and number when so positioned in mutual lateral contact as to provide a single rectangular void space among the pieces; the flattened pieces being slidable on the plane of the platform subject to lateral restraint by one another; and the object of the puzzle being to proceed from a designated starting configuration of the flattened pieces, and interchange the respective initial positions of designated of the flattened pieces by successive sliding movements of pieces into and out of the said void space.

According to the improvement, the flattened pieces are slidingly interengaged with adjacent such pieces, and the frame and pieces adjacent thereto are slidingly interengaged, whereby the said pieces may be interslid in the plane of said platform on which they are disposed in an effort to solve the puzzle, while maintaining integrity of the entire puzzle and precluding removal of the pieces from the plane. The frame and base piece are interlocked by structures which are manually actuatable by the user of the puzzle to enable separation and subsequent reassembly of the base piece and frame; whereby the user upon concluding that the movements of the flattened pieces to a then arrived at configuration will not enable solution of the puzzle, may disengage the base and frame, restore the flattened pieces to their starting configuration, and then reassemble the frame and base piece, thereby enabling restarting of his or her efforts to solve the puzzle.

3 Claims, 4 Drawing Sheets

PUZZLE CONSTRUCTION

FIELD OF THE INVENTION

This invention relates generally to amusement devices, and more specifically relates to a puzzle construction, the elements of which are manipulable by the user who endeavors to solve the puzzle.

DESCRIPTION OF THE PRIOR ART

Puzzles of various types have served as a source of amusement (and education)for mankind for at least as long as the existence of historical records. One type of puzzle which dates back to antiquity, is based upon the manipulation of a plurality of interacting pieces in order to attain a previously identified result or configuration. In one well-known type of such puzzle the user seeks to arrange or rearrange displaceable pieces to achieve a desired configuration. Common jig saw puzzles are based on this principle; i.e. in such instance the user seeks to intermesh a large number of pieces to yield a pattern such as a picture or design.

The present invention relates to a subclass of these types of puzzles, wherein indicia bearing pieces such as blocks, are moved about within a bounding frame, with the objective of transforming an initial arrangement of the blocks to a desired final configuration by sliding the blocks in the plane bounded by the frame. The blocks are slidable upon and cover the surface within the frame, except for a void space into which one or more of the blocks can be moved or parked. As the pieces are moved the void effectively migrates within the frame, enabling new pieces adjacent the void to be moved into same. This process can be continued indefinitely until the desired configuration of the pieces—i.e. that necessary to solve the puzzle—is achieved.

The specific puzzle of the above type to which the invention is applicable, is illustrated in British patent No. 381,813. In this puzzle nine rectangular blocks are provided which are slideable on the flat plane or platform defined within the surrounding rectangular frame. Two of the blocks are squares having an area 1/20th that of the platform surface, six of the blocks are rectangles having an area 1/10th that of the platform, and one block is a square having an area 1/5th that of the platform. The void space is a rectangle having an area 1/10th that of the platform. The objective of the puzzle is to interchange a specified initial position of the large square (1/5th)block with the positions of two of the 1/10th rectangular blocks.

While the device shown in British 381,813 is an attractive and fascinating puzzle, its construction is such as to render it comparatively impractical and difficult to use. The blocks in such construction are simply emplaced upon the platform which is surrounded by the frame. The blocks are not constrained against being lifted from or inadvertently dislodged from the plane of the platform. Particularly in that a puzzle of this type is often used during travel, the arrangement suffers from the same problems as exist with a chess or other game board having unconstrained pieces. While such an arrangement is quite suitable for use on a sturdy table, it is quite impractical for carrying about, for operating while traveling in a plane, automobile or the like- which locales are precisely the sort of places where the amusement value of such a puzzle would be most appreciated.

While it may be noted that other types of puzzles are well known which consist of blocks having alphanumeric indicia thereupon, which blocks are positioned within a frame and intermeshed with the frame and with one another by projecting tabs, such a construction does not lend itself to the puzzle of British 381,813 for a reason that arises from the nature of the latter type of puzzle. Specifically in such a type of device it is necessary in order to solve the puzzle to proceed through a very large number of sequentially correct steps. Experience shows that the solution is so difficult that most individuals will not succeed in their early attempts, whereby sooner or later the user gives up, and desires to start over. Therein lies the difficulty. In order to restore the original or starting configuration where intermeshed or interlocked blocks are present, one has to reverse the complex and lengthy series of steps which gave rise to the impasse. But this is extremely difficult to achieve. In short the interlocked or intermeshed type of puzzle does not normally lend itself to being simply reset to its starting configuration.

SUMMARY OF THE INVENTION

Now in accordance with the present invention a puzzle construction is provided which while having all of the appealing and diverting aspects of the device known in the prior art as discussed above, incorporates feature that enable such puzzle to be readily carried and operated by a user during travel or the like; and which unlike prior art devices is so constructed that it may be accurately and simply reset if the user wishes to do so.

Pursuant to the present invention therefore an improvement is provided which is applicable to a puzzle of the type including a rectangular base piece, a raised rectangular frame surrounding the sides of said base piece and defining therewith a recessed platform; and a plurality of rectangular flattened pieces which are positionable on said platform within said frame, and of dimensions and number when so positioned in mutual lateral contact as to provide a single rectangular void space among the pieces. In this type of puzzle, the said flattened pieces am slidable on the plane of the platform subject to lateral restraint by one another, the object of the puzzle being to proceed from a designated starting configuration of the flattened pieces, and interchange the respective initial positions of designated of the flattened pieces by successive sliding movements of pieces into and out of the said void space.

In accordance with the present invention, the flattened pieces are slidingly interengaged with adjacent such pieces, and the frame and pieces adjacent thereto are slidingly interengaged, whereby the said pieces may be interslid in the plane of the platform on which they are disposed in an effort to solve said puzzle, while maintaining integrity of the entire puzzle and precluding removal or dislodgement of the pieces from the said plane. The frame and base piece are interlocked by means which are manually actuatable by the user of the puzzle to enable separation and subsequent reassembly of the base piece and frame; whereby the user upon concluding that the movements of the flattened pieces to a then arrived at configuration will not enable solution of the puzzle, may disengage the base and frame, restore the flattened pieces to their starting configuration, and then reassemble the frame and base piece, thereby enabling restarting of his or her efforts to solve the puzzle.

Preferably each of the flattened pieces has recessed tracks on two adjoining lateral edges and a projecting fin-like tab extending along the remaining two lateral edges. The frame defines with the base piece a further recessed track extending about two sides of the platform a fin-like rail extends from each of two lateral members at the remaining two sides of the frame. The tabs of the flattened pieces are engaged in the frame track where they border same; and the rails provided at the remaining sides of the frame are engaged in the recessed tracks of the flattened pieces where such pieces border the side of the frame provided with the rails.

The puzzle preferably further includes user readable indicia defining the initial arrangement of the pieces of the puzzle, to enable the user to configure the pieces to the starting configuration for the puzzle. Each of the blocks may thus be provided with user readable indicia; and the platform may be is provided with user readable indicia and optionally shape patterns matching the indicia and shapes of the flattened pieces. The indicia and optional patterns on the platform define the initial arrangement of the pieces of the puzzle to enable the user to configure the pieces to the starting configuration for the puzzle.

The puzzle may have nine of the rectangular flattened pieces, two of which are squares each having an area 1/20th that of the platform, six of which are rectangles having an area 1/10th that of the platform, and one of which is a square having an area 1/5th that of the platform; and the void space can be a rectangle having an area 1/10th that of the platform.

BRIEF DESCRIPTION OF THE DRAWINGS

A fuller understanding of the present invention may now be gained from a reading of the following description, and by simultaneous review of the appended drawings. The drawings should not be construed as limiting the present invention, but are intended to be exemplary only.

DETAILED DESCRIPTION OF THE PREFERRED EMBODIMENT

Figure 1:
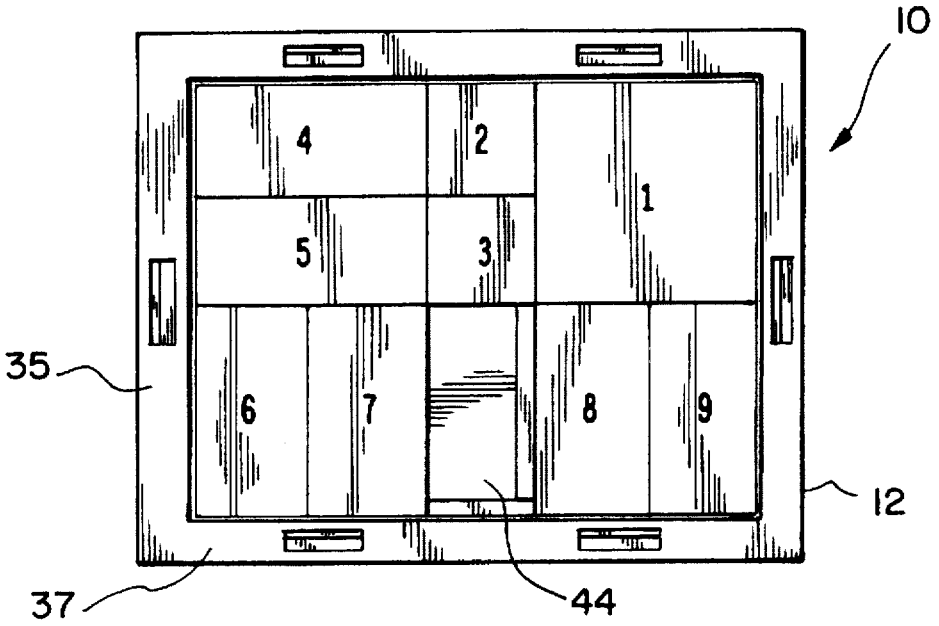
FIG. 1 is a top plan view of a puzzle construction in accordance with the present invention.
Figure 2:
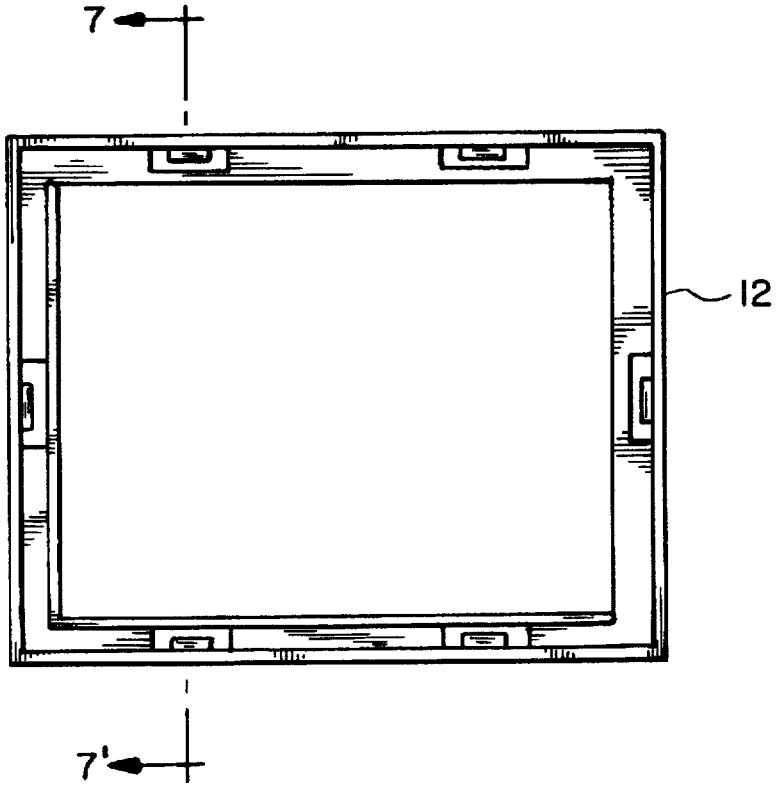
FIG. 2 is a rear plan view of the frame portion of the puzzle of FIG. 1.
Figure 5:
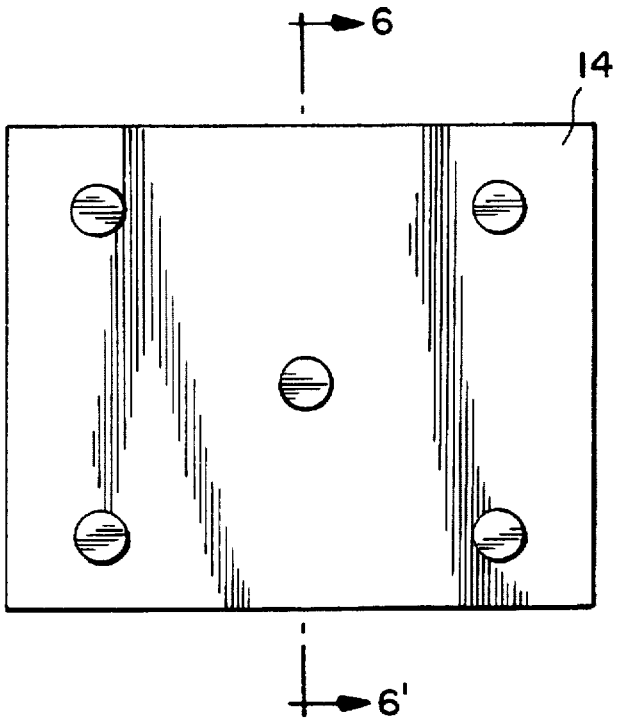
FIG. 5 is a bottom plan view of the base piece of FIG. 3.
Figure 6:
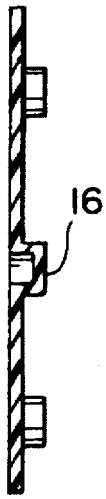
FIG. 6 is a cross-sectional view of the base piece of FIG. 5, taken along the line 6—6' therein.

Referring to FIG. 1, there is shown a top plan view of a puzzle 10 in accordance with the present invention. This Figure can be considered simultaneously with several of the remaining Figures, particularly the exploded partial assembly view of FIG. 3. Puzzle 10 includes a frame 12 in which a back piece 14 is receivable. The rear side of back piece 14 is provided with a plurality of feet 16—seen in FIGS. 5 and 6—which assist in stabilizing the puzzle when placed on a table or the like. The inside surface of base piece 14 is provided with indicia 18 which take the form of numerals which correspond to the numerals present on the plurality of flattened pieces 20 which are positioned upon the platform 22 defined when piece 14 is received within the frame 12. Optionally further shape patterns such as shown in dotted lines at 24 and 26 can also be formed upon the interior of piece 14, which patterns show the shape of the specific flattened piece 20 which is to be overplaced upon platform 22 when the puzzle is assembled or reset by the user. Pieces 20 are nine in number, and have fractional areas with respect to platform 22 as discussed for the prior art device of British Patent 381,813.

Figure 3:
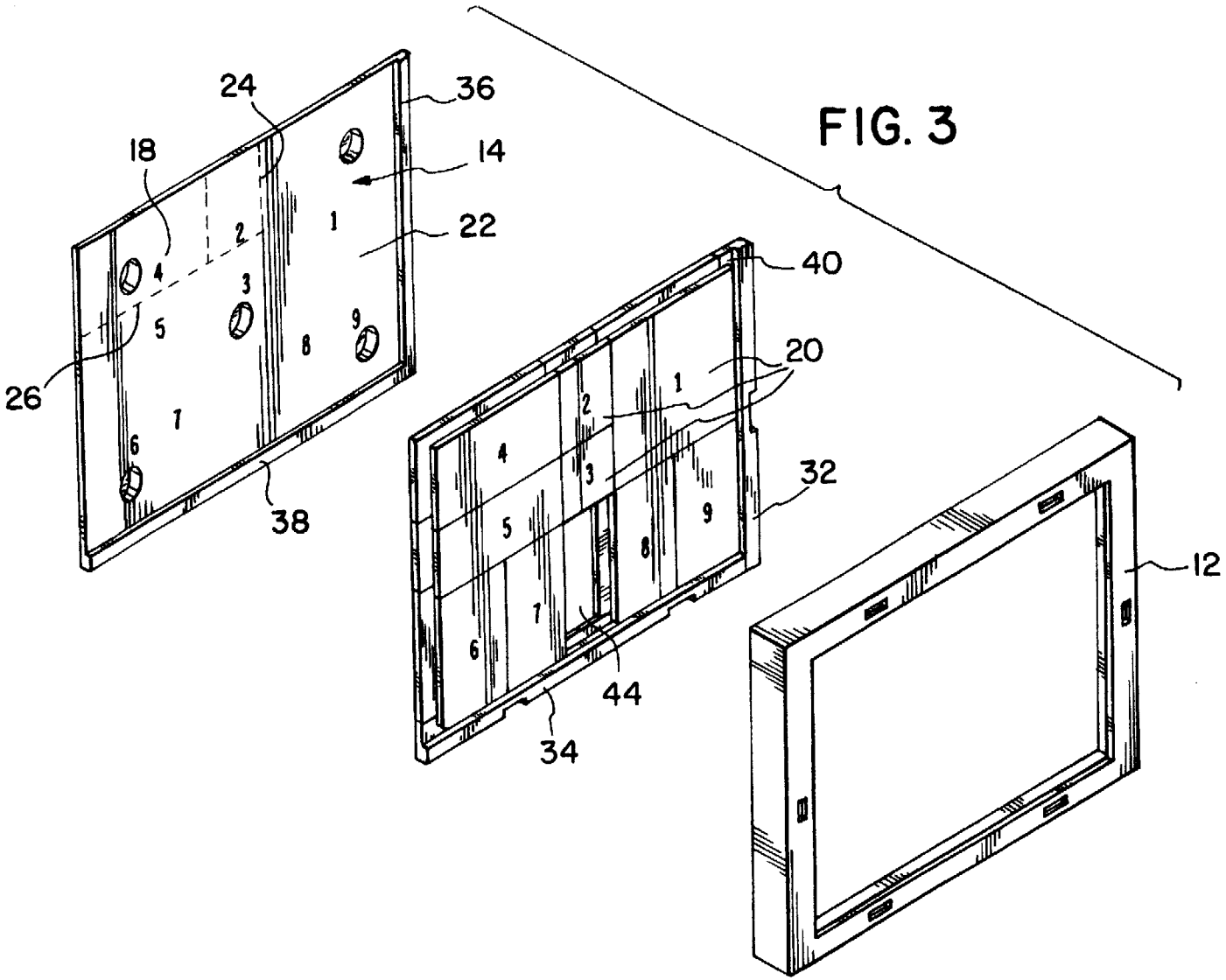
FIG. 3 is an exploded view of the frame, base piece and flattened pieces forming part of the present construction, and showing the flattened pieces engaged with the lateral rail members of the frame.
Figure 4:
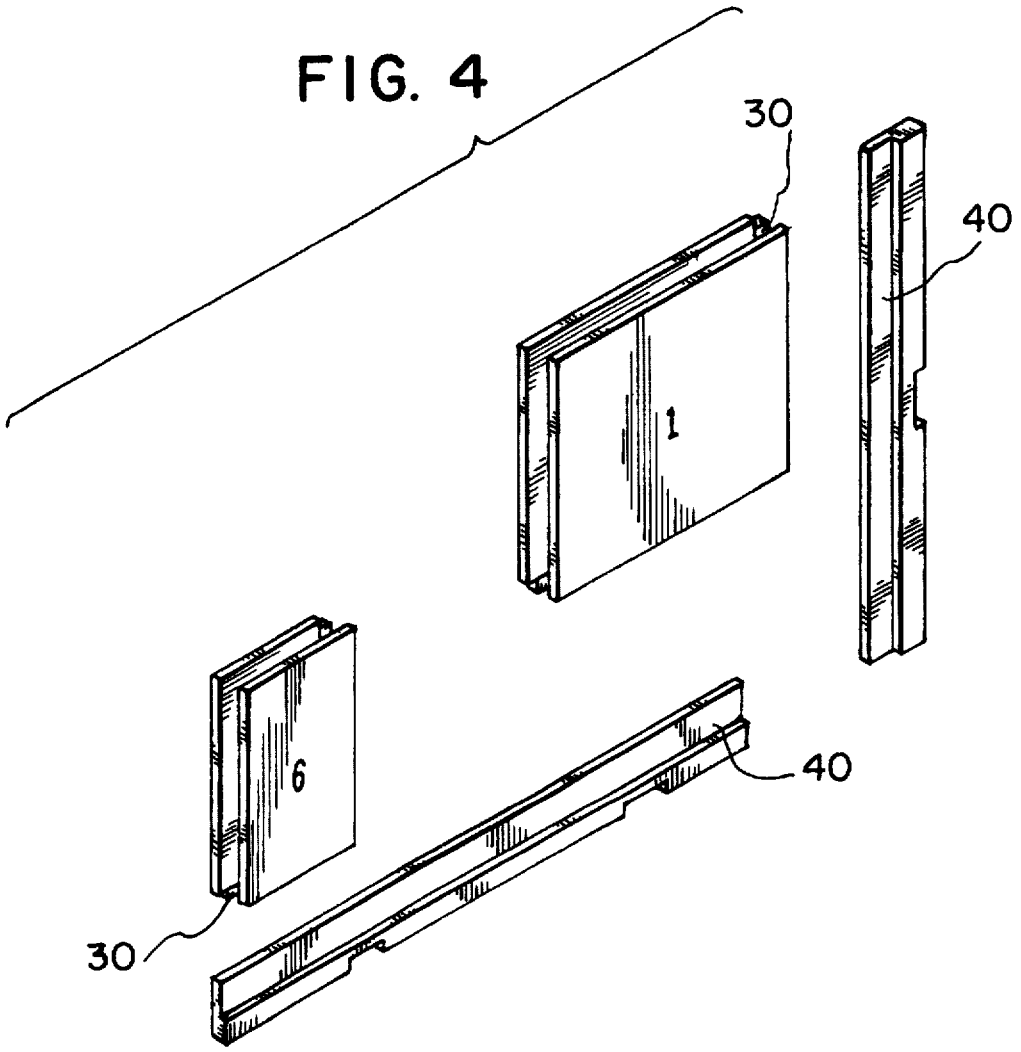
FIG. 4 is an exploded assembly view of the lateral members, showing how several flattened pieces are engageable therewith.
Figure 9:
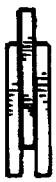
FIG. 9 is a left end view of the piece shown in FIG. 8.
Figure 8:
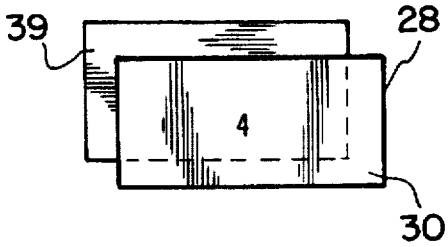
FIG. 8 is a top plan view of a representative slideable flattened piece used in the puzzle.
Figure 10:
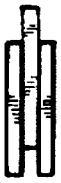
FIG. 10 is a right end view of the piece shown in FIG. 8.

As seen in FIGS. 8,9, and 10, each of the flattened pieces such as that representatively shown at 28, is provided with a groove or track 30 extending along two lateral edges (e.g. the right and lower edges as shown), and with fin-like tabs 39 which extend along the remaining two edges (e.g. the left and upper edges as shown). When the assembly of FIG. 3 is brought together, lateral members 32 and 34 sit atop shoulders 36 and 38 of base piece 14. The rails 40 on members 32 and 34 thus extend along two adjacent inwardly facing sides of frame 12 are received in the tracks 30 of pieces 20 which are adjacent members 32 and 34. This relationship can be best seen in the exploded view of FIG. 4. In turn each of the pieces 20 is slidingly interengaged with its neighbor or with the adjacent portion of frame 12. Correspondingly recessed tracks are formed under edges 35 and 37 of frame 12, which tracks receive the tabs 39 of adjacent pieces 20.

Figure 7:
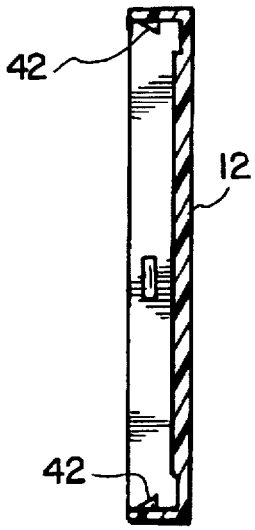
FIG. 7 is a cross-sectional view of the frame of FIG. 2, taken along the line 7—7' therein.

As may be seen in FIG. 7 internal projections 42 extend inwardly from frame 12. Six such projections are provided about the frame. Frame 12 and the other components of puzzle 10 are molded of a tough but somewhat flexible plastic such as polypropylene or the like. Accordingly when the assembly of FIG. 3 is brought together, the base piece 14 may be pressed against the frame until it snaps in place lodged atop the projections 42. A most important aspect of the invention, however, is that the resulting assembly can be readily disassembled by a user of the puzzle. By slightly twisting the lateral edges of the frame 14, base piece 12 can be dropped off projections 42 to enable such disassembly. In use the objective of the puzzle 10 is to interchange the position of piece "1" (quotations are used here to identify indicia—as opposed to reference numerals) with that of the pieces "4" and "5". That is one seeks by sliding the nine pieces 20 among themselves (utilizing the void 44), to end up with piece "1", i.e. the largest such piece (having an area of 1/5th that of the platform 22), repositioned at the space initially occupied by pieces "4" and "5". The pieces "4" and "5", each of which have an area 1/10th that of platform 22, are in turn to be moved to the space initially occupied by piece "1". (It is acceptable for pieces "4" and "5" to be in either of the two possible arrangements in their new space.) In the event, which in practice is all too likely, that the user finds after a series of movements of the pieces 20 that he or she is stymied, rather than being required to attempt reversing the said steps to achieve the starting configuration, the puzzle can simple be dissembled in the manner discussed, and by use of the indicia provided at the platform 22, the puzzle can be reset and then reassembled for reinitiation of the puzzle solving steps.

While the present invention has been described in terms of specific embodiments thereof, it will be appreciated in view of the foregoing disclosure, that numerous variations upon the invention are now enabled to those skilled in the art, which variations yet reside within the scope of the present teaching. Accordingly, the invention is to be broadly construed, and limited only by the scope and spirit of the claims now appended hereto.

What is claimed is:

1. In a puzzle of the type including a rectangular base piece, a raised rectangular frame surrounding the sides of said base piece and defining therewith a recessed platform; and a plurality of rectangular flattened pieces which are positionable on said platform within said frame, and of dimensions and number when so positioned in mutual lateral contact as to provide a single rectangular void space among the pieces; the said flattened pieces being slidable on the plane of said platform subject to lateral restraint by one another; and the object of the puzzle being to proceed from a designated starting configuration of the flattened pieces, and interchange the respective initial positions of designated of the flattened pieces by successive sliding movements of pieces into and out of the said void space; the improvement comprising:

said flattened pieces being slidingly interengaged with adjacent such pieces, and said frame and pieces adjacent thereto being slidingly interengaged, whereby the said pieces may be interslid in the plane of said platform on which they are disposed in an effort to solve said puzzle, while maintaining integrity of the entire puzzle and precluding removal of the pieces from the said plane;

each of said flattened pieces having recessed tracks on two adjoining lateral edges and a projecting fin-like tab extending along the remaining two lateral edges; the frame defining with said base piece a further recessed track extending along two sides of said platform; the tabs of adjacent flattened pieces being engaged in the said tracks; and the frame defining with said based piece a rail extending along the remaining two sides of said platform for being received in the adjacent tracks of said flattened pieces;

said frame and base piece being interlocked by means which are manually actuatable by the user of the puzzle to enable separation and subsequent reassembly of the base piece and frame; whereby the user upon concluding that the movements of the flattened pieces to a then arrived at configuration will not enable solution of the puzzle, may disengage the base and frame, restore the flattened pieces to their starting configuration, and then reassemble the frame and base piece, thereby enabling restarting of his or her efforts to solve the puzzle;

said puzzle further including user readable indicia defining the initial arrangement of the pieces of said puzzle, to enable the user to configure the pieces to the starting configuration for said puzzle; each of said flattened pieces being provided with said user readable indicia; and the said platform being provided with user readable indicia matching the indicia of said flattened pieces; the indicia on said platform defining the initial arrangement of the pieces of said puzzle to enable the user to configure the pieces to said starting configuration.

2. A puzzle in accordance with claim 1, wherein the platform is provided with user readable shape patterns matching the shapes of the flattened pieces, to enable the user to configure the pieces to the starting configuration for said puzzle.

3. A puzzle in accordance with claim 1, having nine of said rectangular flattened pieces, two of which are squares each having an area 1/20th that of said platform, six of which are rectangles having an area 1/10th that of said platform, and one of which is a square having an area 1/5th that of said platform; and said void space being a rectangle having an area 1/10th that of said platform.

* * * * *